United States Patent [19]

Thomas

[11] 4,008,498

[45] Feb. 22, 1977

[54] TUB PAD

[76] Inventor: Stephen R. Thomas, 5706 N. Mason, Chicago, Ill. 60646

[22] Filed: June 18, 1975

[21] Appl. No.: 587,991

[52] U.S. Cl. ..... 4/180; 4/185 R; 5/347

[51] Int. Cl.[2] ..... A61H 9/00; A61H 33/06

[58] Field of Search ..... 5/347; 4/152, 162–164, 4/173, 177, 180, 185 R, 185 F, 185 HB; 128/66; D83/1 C

[56] References Cited

UNITED STATES PATENTS

| | | | |
|---|---|---|---|
| 1,501,739 | 7/1924 | Benedek | 4/185 F |
| 1,777,982 | 10/1930 | Popp | 4/180 |
| 2,140,902 | 12/1938 | Fischer | 4/185 F |
| 2,503,174 | 4/1950 | Salvadore | 4/185 F |
| 3,772,717 | 11/1973 | Yuen | 5/347 X |
| 3,870,040 | 3/1975 | Klages | 4/180 X |
| 3,909,859 | 10/1975 | Harris | 4/185 R X |

*Primary Examiner*—Richard E. Aegerter
*Assistant Examiner*—Stuart S. Levy
*Attorney, Agent, or Firm*—Dominik, Knechtel, Godula & Demeur

[57] ABSTRACT

A water fillable pad for positioning on the tub bottom, the top wall of said water fillable pad having a plurality of elongated air tubes serially apertured, and a compressor with a heating element delivering heated compressed air through a manifold tube to said air tube so heated bubbles rise and agitate the tub water around the bather. The water fillable pad has a hingedly connected air inflatable back rest and an air inflatable side pad which drapes over the tube side wall and down to the float surface. A foot drain tray assembly is mounted to the free side edge of the air inflatable side pad member on which a bather can stand after finishing his bath. The foot drain tray assembly can be tucked under the water fillable pad when arching the air inflatable side pad member, thus forming a dome for the bather and a capture space for the discharged air bubbles.

7 Claims, 5 Drawing Figures

TUB PAD

This invention relates to water fillable and air inflatable pad members for a tub; and particularly relates to a water fillable pad positioned on a tub bottom and associated with means to deliver agitating bubbles through the tub water and around the bather. Other features of the invention will be disclosed hereinafter.

Water beds have gained popularity, and it is desired to utilize some of the advantages associated with such water beds in a new environment to attain particular advantages. The advantages of water bed structures are used in new ways in a pad construction for placement on the tub bottom to support a bather, thus leading to new comforts and sensations during bathing. Plastic air inflatable members such as beach mattresses, toys, floats, and the like are well known in the art. By this invention, such features are uniquely combined with the water filled distendable structure in a bathtub environment.

It is, therefore, an important object of the present invention to uniquely combine a water fillable pad for a tub bottom with means to discharge air bubbles through the tub water around the bather. This general object is particularly served by features of combining air inflatable pads with said water fillable pads to attain surprising comfort of an air filled back rest and an air filled side pad advantageously hinged by plastic heat seals to the water fillable member. The air filled backrest evenly distributes back support which would not be available with a water filled backrest, gravity resulting in uneven pooling of the water. The air inflatable side member uniquely operates to anchor the assembly by draping over a tub sidewall in one practice; or being arched over the bather to form a capture space to attain sauna-like conditions for the bubbling water in another practice.

Such general and particular objects are attained together with still other objects and advantages which will occur practitioners, by the invention of the following disclosure which includes drawings wherein.

Figure 1:
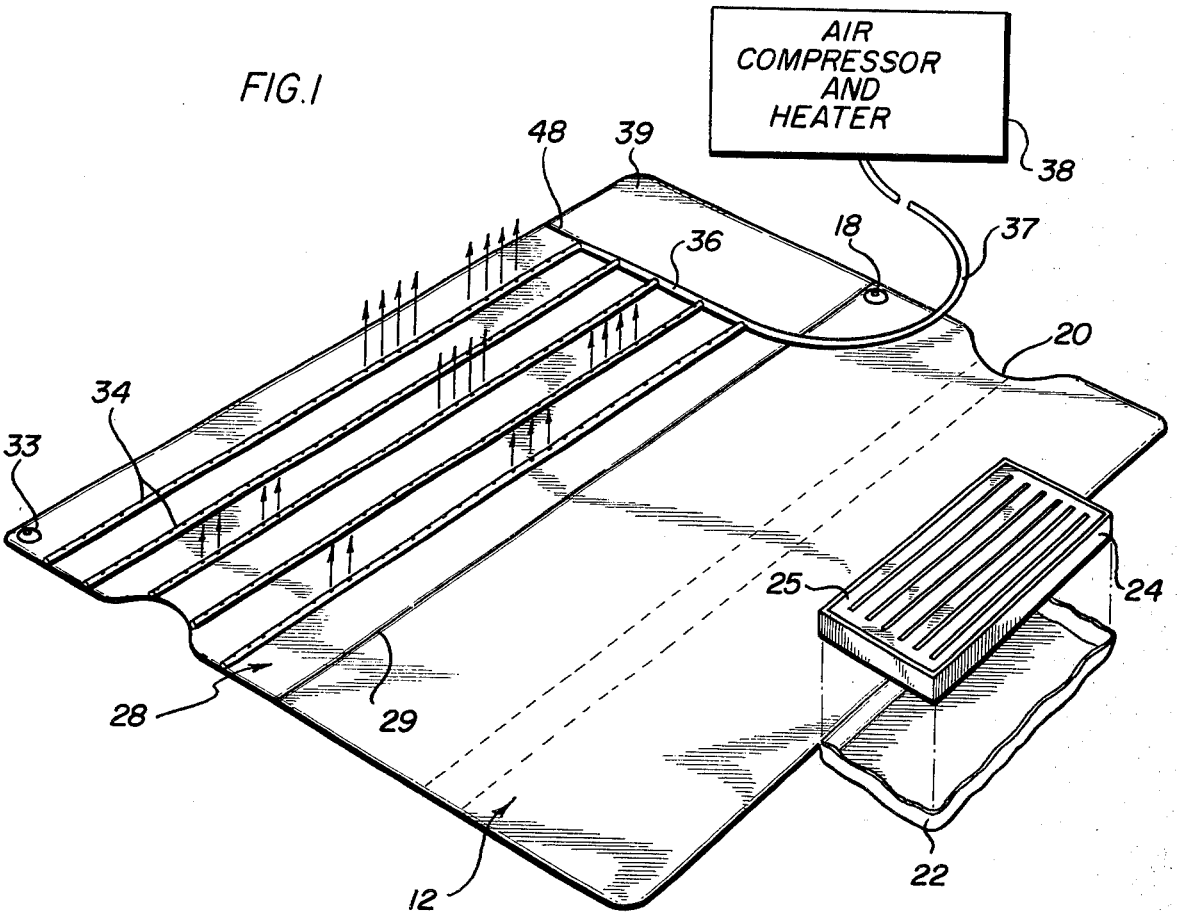
FIG. 1 is a perspective view with parts shown exploded of the water fillable and air inflatable tub assembly.

Looking at the drawings, the view of FIG. 1 shows the water fillable and air inflatable pad assembly which includes an air inflatable pad part 12 having spaced side walls 14 and rounded walls 16 at the edges. An air inlet-outlet valve 18 is shown mounted to the top side wall of the side air inflatable pad 12. A neck arch 20 is formed in the end edge of the side air inflatable member 12 to accomodate a bather, as will be seen.

A foot drain tray assembly is shown mounted to the free side edge of the side air inflatable pad 12. Such assembly includes a bottom tray on floor member 22 in the form of a box with short upright walls along the continuous edge. The box is somewhat resilient and receives a substantially rigid box 24 in telescoping relationship, said box having short depending walls along the continuous edge. The box 24 has a perforate top surface 25 to allow passage of drain water when the bather stands on the substantially rigid box 24. Such water is collected in the space defined by the telescoping boxes.

Figure 3:
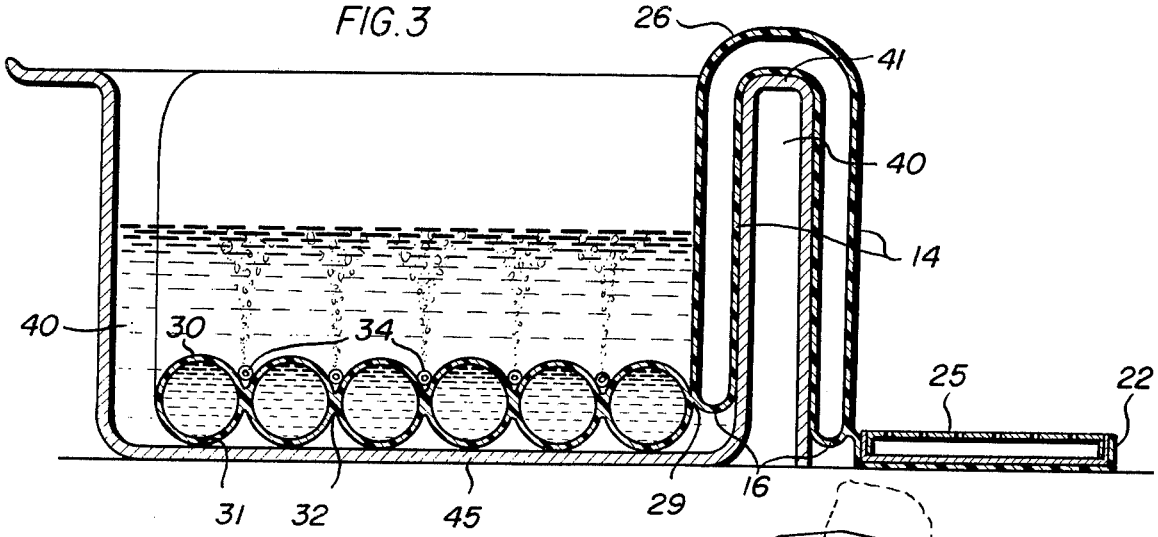
FIG. 3 is a sectional view on an enlarged scale, taken along line 3—3 of FIG. 2.
Figure 5:
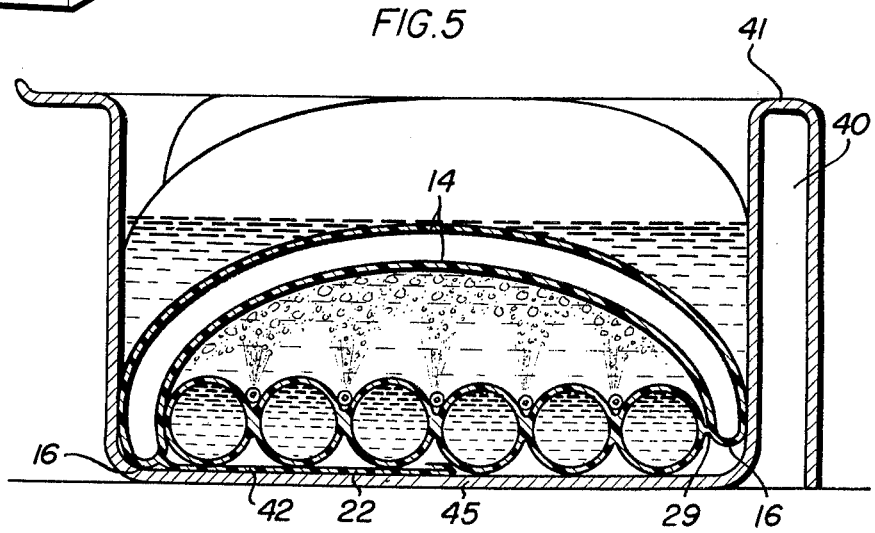
FIG. 5 is a sectional view on an enlarged scale, taken along Line 5—5 of FIG. 4.

The tub pad assembly further includes a water fillable part or pad 28 which is hingedly connected along its side to the side air inflatable pad 12 by an elongated heat seal strip, see FIGS. 3 and 5. This is the preferred embodiment since the water fillable and air inflatable pads of this invention are formed from thermoplastic spaced side walls, such as top wall 30 and bottom wall 31 of the water fillable pad. Such walls are sealed along their continuous edge to define a chamber for the introduced fluid, such as water for pad 28.

The spaced side walls of the water fillable pad 28 are compartmentalized by elongated heat sealed strips 32. The side wall portions between adjacent heat seal strips 32 is wider than the linear width between such adjacent heat seal strips so that water distends the side wall portions to form aligned upper and lower convolutions which together form a series of water cells of tubular configurations in cross section. A water inlet-outlet valve 33 is shown in the top wall of the water fillable pad 28. The water and air valves used with the pads in this invention may be of conventional construction, and will not be further described.

The top wall of water fillable member 28 is provided with a plurality of elongated apertured air tubes 34, each tube shown positioned atop the elongated heat seal strips 32. The tubes are shown extending to the opposite ends of the water fillable pad and the apertures are serially aligned at top dead center of the air tubes. This is preferred for obtaining an effective upward path of the rising air bubbles, although other placements of the apertures is possible along the air tubes. The air tubes are preferably bonded to the elongated heat seal strips 34, although bonding sites may include adjacent portions of the top wall of the water fillable pad 28. The air tubes 34 are joined to a transverse manifold tube 36, and such manifold tube is joined by a connecting tube portion 37 to an air compressor, preferably provided with heating element, both diagramatically illustrated at 38.

The water fillable and air inflatable pad assembly is also preferably provided with an air inflatable back rest pad 39 which is similarly formed from spaced side walls sealed along a continuous edge. The back rest pad 39 is hingedly connected to an end of the water fillable pad 28 by a transverse elongated heat sealed plastic strip 40. The air chamber within the back rest pad 39 preferably communicates by an air passageway (not shown) with the air chamber within the side air inflatable pad 12. In this way, the single air inlet-outlet valve 18 can be used for filling and deflating both air inflatable pads.

Figure 2:
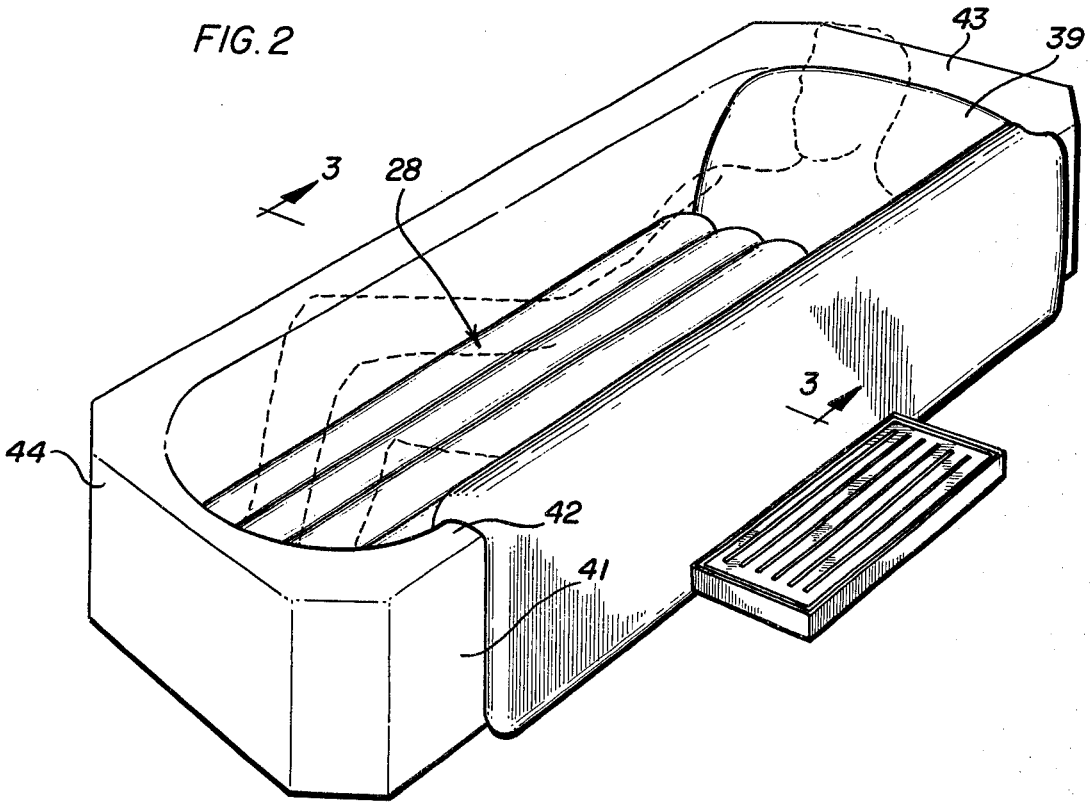
FIG. 2 is a perspective view of the assembly in FIG. 1 mounted in position to improve bathing conditions.

The use and operation of the assembly will be described relative to two alternate forms. One form is indicated in the view of FIG. 2 wherein the air inflatable side pad 12 is draped over the tub side wall 41, a midline area of the side inflatable pad straddles the top tub wall 42 of the tub side wall 41, such midline area indicated by dotted lines in the view of FIG. 1.

The inflatable side pad has a sufficient width to drape conventional tub sidewalls, one side edge being hingedly connected at 29 to the water fillable pad 28, and the opposite free side edge adjoining the floor surface outside the tub. In this form, the side inflatable pad helps to anchor the assembly relative to the tub, and further allows the foot drain tray assembly to extend along the floor surface, as shown.

The length of the side air inflatable side pad is coextensive with the length of the water fillable pad 28, and both such lengths cover at least a major portion of the length of the conventional tub. In the form shown, the water fillable pad 28 has one end adjoining the tub head wall 43 and the opposite end adjoining the tub foot wall 44.

Figure 4:
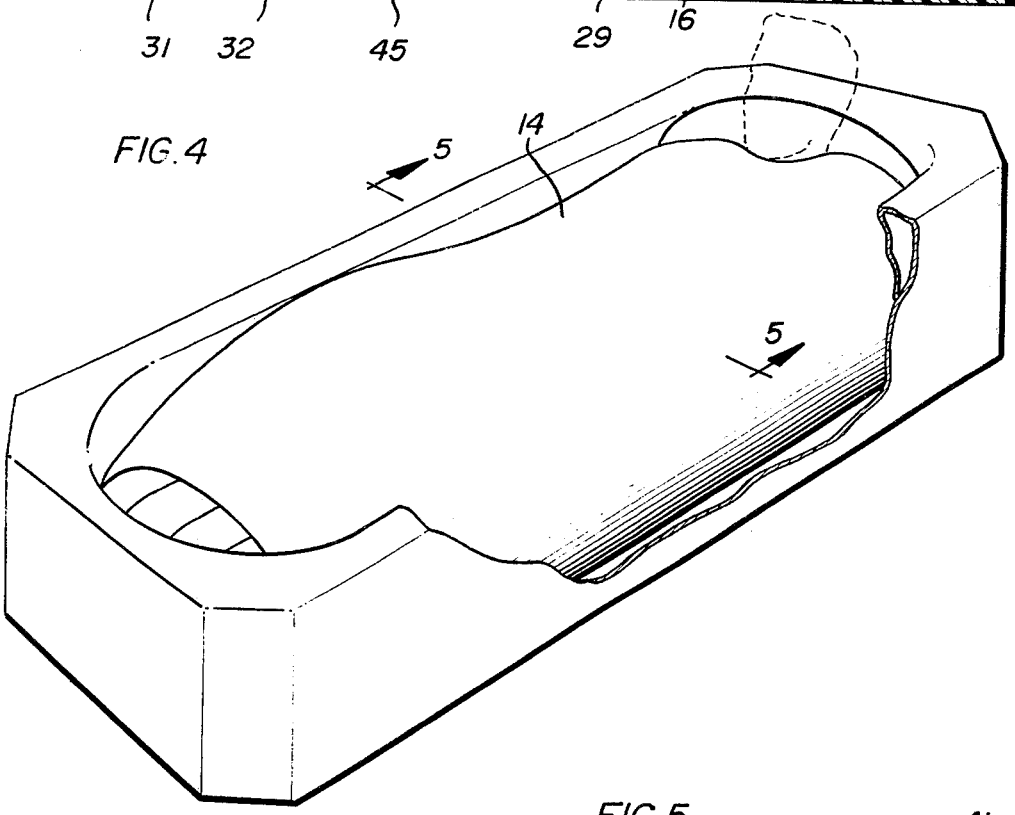
FIG. 4 is a perspective view similar to that of FIG. 2, but showing the water fillable and air inflatable pad assembly in different use.

Another form of the practice of the invention is shown in the view of FIG. 4 wherein the air inflatable side pad 12 is arched over the bather to assume a dome-like configuration. The box portion 22 of the foot drain tray assembly is resilient, and is tucked under the water fillable pad 28 to hold the side pad in the arched configuration. This allows a somewhat sauna effect to be attained since a capture space is provided between the water fillable pad 28 and the air inflatable side pad 12. The bubbles released from the air tubes 34 agitate the tub water in this captured space to enhance the bathing experience. The neck arch 20, in this form, accomodates the reclining bather, the air inflatable pad shown extending to abut the opposite ends of the tub.

The connecting tube portion 37 may have a removable top fitting, in the form of an elastomeric funnel, to engage the tub or sink top for filling the pad. The top fitting may then be removed to allow connection of the tube to the air compressor, with or without a special fitting.

The claims of the invention are now presented, and the terms of such claims may be further understood by reference to the language of the preceding specification and the views of the drawings.

What is claimed is:

1. A hollow body water fillable assembly including a water fillable pad member dimensioned to be received on a tub bottom to support a bather, said pad having top and bottom side walls sealed along a continuous edge, a water inlet-outlet valve in the top side wall of the water fillable pad member, a plurality of air tubes mounted to said top side wall and extending towards the opposite ends of the water fillable pad member, a series of apertures along the length of each tube, a manifold tube joined to said plurality of air tubes, means to deliver compressed air, a side air inflatable pad member hinged to the side of said water fillable pad member, said side air inflatable pad member having spaced sidewalls sealed along a continuous edge, and said side pad member having dimensions to cover the bather when draped over the top of the tub, and means connecting said side pad member with said means to deliver compressed air, and a connecting tube joining said manifold tube and the compressed air means to deliver air to said plurality of air tubes for discharge through said apertures to create bubbling agitation through tub water.

2. A water fillable pad member as in claim 1 which further includes an air inflatable back rest pad hinged to an end of said water fillable pad member, said back rest member dimensioned to lay against the tub back wall, said back rest pad member having spaced sidewalls sealed along a continuous edge, and means communicating said back rest pad and the means to deliver compressed air.

3. A water fillable pad member and assembly as in claim 2 a communicating air passageway is between said back rest pad and said side pad, and an inlet-outlet air valve is mounted to a sidewall of said back rest and pad members.

4. A water fillable pad member and air inflatable pad assembly as in claim 3 wherein said side air inflatable pad member has a length coextensive with the length of said water fillable member, said pads having plastic walls, and said side pad member being hinged to said water fillable member by an elongated heat-sealed plastic strip.

5. A water fillable pad member and air inflatable pad assembly as in claim 4 which further includes a foot drained tray assembly mounted to the free side of said side air inflatable pad member, said foot drain tray assembly including a flexible member connected to an edge of said free side of said side air inflatable pad, and further including a separated, rigid perforate member removably mounted on top of said flexible member.

6. A water fillable pad member and air inflatable pad assembly as in claim 5 wherein said flexible member of the tray assembly includes upright walls along its continuous edge, and said perforate member includes depending walls along its continuous edge, the respective walls of said perforated and flexible members being relatively dimensioned to a-low said perforate member to be telescopically seated within the flexible member.

7. A water fillable pad member and air inflatable pad assembly as in claim 2 further including means associated with said compressed air source means to heat the delivered compressed air, and a foot drain tray assembly joined to a free side edge of said side air inflatable pad, said foot drain tray assembly including a plastic box having a floor member joined to the free side edge of the side air inflatable pad and three upright plastic walls, and a substantially rigid perforate box telescopically fitting within the upright walls of the connected floor member.

* * * * *